US005957422A

United States Patent [19]

Shea

[11] Patent Number: 5,957,422

[45] Date of Patent: Sep. 28, 1999

[54] REINFORCED STRIP DISPLAY ASSEMBLY CAPABLE OF SUPPORTING HIGH VOLUMES OF SMALLER IMPULSE MERCHANDISE

[76] Inventor: Thomas M. Shea, 1407-C Allen Dr., Troy, Mich. 48083

[21] Appl. No.: 08/888,558

[22] Filed: Jul. 7, 1997

[51] Int. Cl.[6] ..... A47B 96/06

[52] U.S. Cl. ..... 248/220.31; 248/220.41; 211/87.01

[58] Field of Search ..... 248/239, 220.41, 248/220.42, 220.43, 221.11, 300; 211/87.01, 103, 59.1, 57.1, 175

[56] References Cited

U.S. PATENT DOCUMENTS

| | | | |
|---|---|---|---|
| 257,351 | 4/1882 | Snyder | 211/103 |
| 3,935,357 | 1/1976 | Padovani | 428/166 |
| 4,286,006 | 8/1981 | Boelter | 428/182 |
| 4,461,443 | 7/1984 | Dauman | 211/87.01 |
| 4,629,075 | 12/1986 | Hutten | 211/89 |
| 4,718,627 | 1/1988 | Fast et al. | 248/225.1 |
| 4,767,012 | 8/1988 | Simmons | 211/89 |
| 4,911,392 | 3/1990 | Fast | 248/220.3 |
| 5,096,070 | 3/1992 | Jaynes | 211/72 |
| 5,284,259 | 2/1994 | Conway et al. | 211/73 |
| 5,370,249 | 12/1994 | Harvey et al. | 211/189 |
| 5,386,916 | 2/1995 | Valiulis | 211/113 |
| 5,405,022 | 4/1995 | Rissley | 211/59.1 |
| 5,415,370 | 5/1995 | Valiulis | 248/220.4 |
| 5,526,944 | 6/1996 | Merl | 211/87 |
| 5,547,088 | 8/1996 | Belokin et al. | 211/87 |
| 5,553,721 | 9/1996 | Gebka | 211/59.1 |
| 5,620,104 | 4/1997 | Maglione | 211/59.1 |
| 5,657,884 | 8/1997 | Zilincar, III | 211/86.01 |
| 5,678,702 | 10/1997 | Menaged et al. | 211/87 |
| 5,762,207 | 6/1998 | Maglione | 211/59.1 |

*Primary Examiner*—Derek J. Berger
*Assistant Examiner*—Kimberly T. Wood
*Attorney, Agent, or Firm*—Gifford, Krass, Groh, Sprinkle, Anderson & Citkowski, P.C.

[57] ABSTRACT

A strip display assembly capable of being suspended from an existing commercial shelving construction and suitable for supporting high volumes of small impulse merchandising in addition to the merchandise carrying ability of the existing construction. An elongate body includes an upper end, a lower end, a front planar face and a rear planar face. A bracket secures to the upper end of the display assembly and suspends the assembly in vertical fashion from the shelving construction. A plurality of corrugations extend an axial length of the elongate body and separate the front and rear planar faces according to a selected thickness to provide reinforcing and rigid support to the display assembly along the axially extending direction. Pairs of spaced apart apertures are formed through the front and rear planar faces of the body at spaced apart intervals along the axial length of the body. A plurality of merchandise support members are provided which are individually attachable to the strip display assembly. Each of said support members includes a pair of hook engaging portions for securing to a selected pair of apertures and an elongate merchandise support arm extending from a selected one of said front and rear planar faces.

4 Claims, 3 Drawing Sheets

REINFORCED STRIP DISPLAY ASSEMBLY CAPABLE OF SUPPORTING HIGH VOLUMES OF SMALLER IMPULSE MERCHANDISE

BACKGROUND OF THE INVENTION

1. Field of the Invention

The present invention relates generally to merchandising display strips and other related merchandising assemblies and, more particularly, to a reinforced strip display assembly particularly suited for use with an existing shelving construction which is capable of supporting high volumes of smaller impulse merchandise.

2. Description of the Prior Art

Merchandising strip devices are well known in the art for use with existing commercial shelving constructions, the purpose of such devices being to support volumes of small, high-volume merchandise that are in addition to that which is capable of being carried by the conventional shelving. Such strip devices are particularly well suited for sales of impulse and point-of-purchase items which have become a staple of all commercial retail institutions.

Among the many strip merchandising devices which are known include U.S. Pat. No. 5,386,916, issued to Valiulis which teaches an adjustable strip merchandiser consisting of an elongated plastic strip which is holed at an upper end thereof so that the strip may be vertically suspended from an existing shelving unit and a plurality of individual sections which are divided by transversely extending score lines and which permit sections of the strip to be folded and reattached to the suspending member. Merchandising support is provided by pluralities of individual and axially spaced suspension hooks which face upwardly and which are sandwiched between downwardly facing and outer stabilizing fingers. U.S. Pat. Nos. 4,718,627, issued to Fast, and 5,553,721, issued to Gebka, teach substantially identical variations of the clip strip arrangement of Valiulis.

U.S. Pat. No. 5,284,259, issued to Conway et al., also teaches a similar merchandising strip construction as shown in Valiulis which is provided in a generally integral one-piece fashion and which is capable of supporting merchandise on both sides of the strip. U.S. Pat. No. 4,911,392, issued to Fast, teaches a still further variation of a strip merchandiser with reinforcing section in the form of a perimeter encircling band which enables more than one individual piece of merchandise to be supported by a central and upwardly extending tongue cut-out portion of the strip.

U.S. Pat. No. 4,767,012, issued to Simmons, teaches a strip hanger specifically useful for supporting bags of potato chips and other snack products and which includes an elongate base upon one side of which is formed in longitudinally extending fashion a plurality of individual lever portions. The lever portions are each provided by elongate members which are arranged at spaced apart distances from the base by a central pivot or fulcrum point. Pressing on a rear side of the lever causes a corresponding front side to pivot outwardly and an inwardly flanged portion to unseat from an associated groove defined within the face of the body. When released, the inwardly flanged portion pinches an edge of a foil bag or like merchandising article to suspend it from the strip.

While the clip-strip type of merchandising display devices as discussed above provide convenient display of certain types of merchandising, they suffer from the distinct shortcoming that they are all constructed of relatively thin, relatively flimsy elongated bodies. As such, the individual tongue engaging portions located along the various strips are capable of holding at the most one or two pieces of a type of merchandising which in combination fairly limits both the volume and type of items which may be supported. Also, care must be taken to not attempt to stock more than one type of merchandising item on one or both sides of a prior art clip-strip display, since to do so would result in undesirable deflection along an axial direction of the strip which is suspended from the conventional shelving construction.

SUMMARY OF THE PRESENT INVENTION

The present invention is a strip display assembly for supporting high volumes of small impulse merchandising, the display assembly capable of being secured to an existing shelving construction. The display assembly includes an elongate body having an upper end, a lower end, a front planar face and a rear planar face which is spaced apart from the front planar face. A bracket extends from a surface of the shelving construction and secures to the upper end of the display for suspending the elongate body in vertical fashion. According to one preferred embodiment the display is suspended at a horizontally spaced distance from the shelving construction by a telescopically extendible bracket and, according to a further embodiment, may be suspended by a hook so as to abuttingly contact a vertically extending face of the shelving construction along its rear planar face.

The front and rear planar faces of the elongate body further include pluralities of apertures formed therethrough at spaced apart intervals along the axial length of the elongate body. A plurality of individual merchandise support members, each of the support members including hook engaging portions for inserting into selected pairs of the apertures and elongate extending merchandise support arms upon which are supported individual pluralities of merchandise, are provided and may be secured to the elongate body at selected axial locations along both forward and rearward faces thereof.

The strip display assembly further includes reinforcing corrugations which extend the axial length of the elongate body between the front and rear planar faces and which establish a desired thickness of the body for providing rigidity and preventing axial deflection over the extending length of the body. The reinforcing means provided thereby permit the location of pluralities of individual merchandising support members along both front and rear planar faces of a spatially suspended display assembly without bending or buckling. The strip display assemblies are further capable of being suspended in back-to-back fashion to further increase their longitudinally extending rigidity.

BRIEF DESCRIPTION OF THE DRAWINGS

Reference will now be made to the attached drawings, when read in combination with the following specification, wherein like reference numerals refer to like parts throughout the several views, and in which.

DESCRIPTION OF THE PREFERRED EMBODIMENTS

Figure 1:
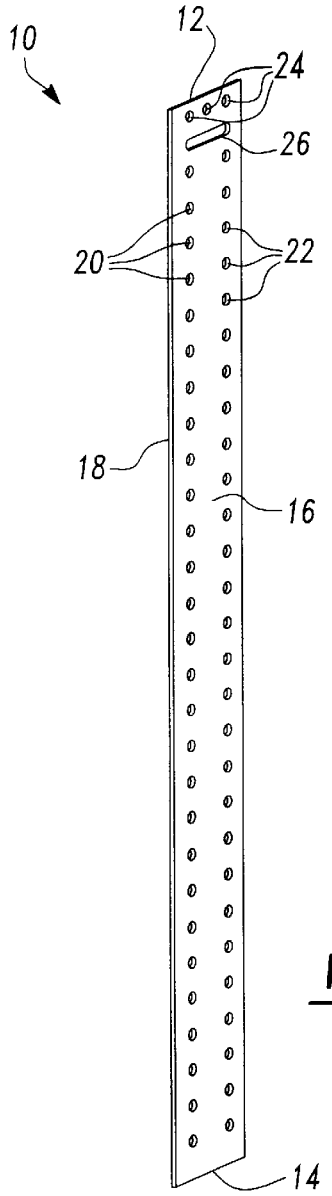
FIG. 1 is a perspective view of an elongated merchandising display strip according to a preferred variant of the present invention.

Referring now to FIG. 1, a strip display assembly 10 is shown according to a first preferred embodiment of the present invention and is configured as an elongated body having an upper end 12, a lower end 14, a front planar face 16 and a rear planar face 18. The display assembly is preferably constructed of a corrugated plastic material or other suitable material, the purpose of which is to provide rigidity and deflection resistant support to the display assembly 10 along both axial and lateral directions 10.

Pluralities of apertures are formed at selected locations through both the front and rear planar faces 16 and 18 and along the axial length the elongated body and are illustrated by a first plurality of spaced apart and vertically extending apertures 20 and a second plurality of spaced apart and vertically extending apertures 22. The pluralities of spaced apart and vertically extending apertures 20 and 22 are arranged in horizontally arrayed pairs from an upper position proximate the upper end 12 to a lower position proximate the lower end 14. As will be subsequently described, the pairs of apertures formed by the vertically extending pluralities 20 and 22 receive merchandising support members for holding pluralities of impulse-type and high-volume merchandise. It is also understood that additional pluralities of vertically extending apertures may be provided along the elongate length of the body, such as by widening the front and rear planar faces 16 and 18. An additional plurality of three apertures 24 extend along the upper end 12 of the elongate display body and a channel 26 extends in a likewise horizontal fashion at a position below the additional apertures 24. The purpose of the additional apertures 24 and the channel 26 is to provide for mounting of the strip display assembly 10 upon the existing shelving construction as will also be subsequently described.

Figure 2:
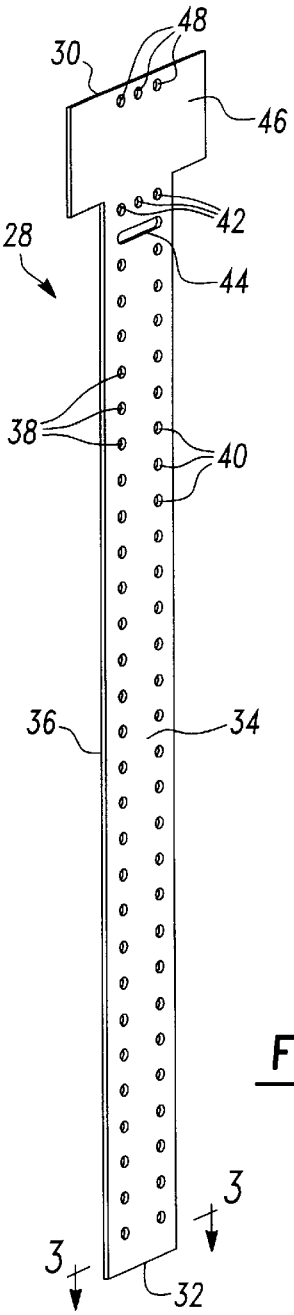
FIG. 2 is a perspective view similar to that shown in FIG. 1 of an elongated merchandising display strip according to a further preferred variant of the present invention.

Referring to FIG. 2, a variation 28 is shown of the strip display assembly which is similar to that shown in FIG. 1 in that it includes an elongate body with an upper end 30, a lower end 32, a front planar face 34 and a rear planar face 36. First and second pluralities of apertures 38 and 40 correspond to pluralities of apertures 20 and 22 of FIG. 1 and additional apertures 42 and channel 44 likewise correspond to elements 24 and 26. The variation 28 of the strip display assembly further includes an enlarged upper end display 46 and a further plurality of apertures 48 are located in horizontally spaced apart fashion along the upper edge of the display 46 for providing suspending support of the variation 28 of the assembly. The purpose of the enlarged upper end display 46 is to provide for on-site advertisement of the merchandising which may be accomplished by affixing a sign or sticker to the planar face of the display 46 which is indicative of the merchandising product carried by the display assembly.

Figure 3:
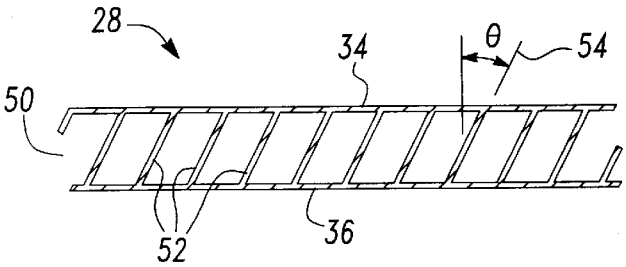
FIG. 3 is a cutaway view taken along line 3—3 of FIG. 2 and illustrating the reinforcing corrugations for separating the first planar face from the second planar face.

Referring now to FIG. 3, a cutaway view of the variation 28 of the strip display assembly is illustrated and shows the front planar face 34 and rear planar face 36 in spaced apart fashion according to a specified thickness 50. The elongate body of the strip display assembly is capable of being constructed of a solid material, however the preferred embodiment contemplates a plurality of corrugations 52 which extend the axial length of the elongate body and in parallel and spaced apart fashion between the front and rear planar faces 34 and 36 and function to add significant reinforcing support to the assembly. The corrugations 52 may be arrayed in any fashion, but are further preferably established at some angle 54 from a perpendicular of the planar faces so as to increase rigidity and deflection resistance along the axial length of the display assembly elongated body. The corrugating of the strip display body further functions to reduce the overall weight of the display while at the same time dramatically increasing its rigidity and deflection resistance.

Figure 4:
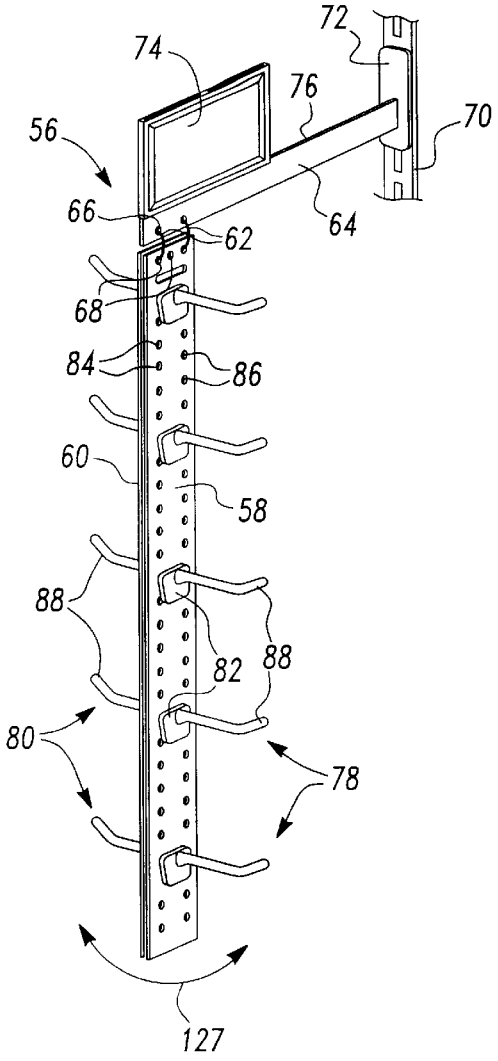
FIG. 4 is an operative view of a variant of the strip display assembly secured in spatially separated and suspending fashion from a vertically extending and single slotted surface of an existing shelving construction according to the present invention.

Referring now to FIG. 4, a variation 56 of the strip display assembly of the present invention is shown and includes a first strip display 58 and a second strip display 60, which are similar to the type illustrated at 10 in FIG. 1, and which are suspended in back to back fashion by a pair of S-hooks 62 extending from a first of a number of different variations of supporting members. The supporting member according to this embodiment is a one-piece suspending bracket 64 having a remote end 66 to which the hooks 62 are affixed and the strip displays 58 and 60 each further include apertures 68 similar to the apertures 24 illustrated in FIG. 1 for the purpose of hanging the strip displays 58 and 60 in suspending fashion at a spaced apart distance from a vertical mounting surface 70 of an existing shelving construction. The surface 70 is illustrated as a single slotted vertical mounting surface and the suspending bracket 64 further includes a planar shaped base 72 which includes engaging portions (not shown) for releasably securing the bracket 64 in horizontally extending fashion from the mounting surface 70. A display sign 74 is also affixed along an upper edge 76 of the bracket 64 for identifying the merchandising to be carried upon the assembly 56.

A first plurality 78 of merchandising support members are illustrated which are mounted at selected locations along the planar face of the first display 58 and a second plurality 80 of support members are likewise mounted to the opposite planar face of the second display 60. The merchandising support members 78 and 80 illustrated in FIG. 4 each include a hook engaging portion 82 for engaging a selected pair of apertures (see pluralities of apertures 84 and 86 for first display 58) and an elongate merchandise support arm 88 extending from the hook engaging portion 82 and upon which pluralities of small and high-volume merchandise are supported.

Figure 10:
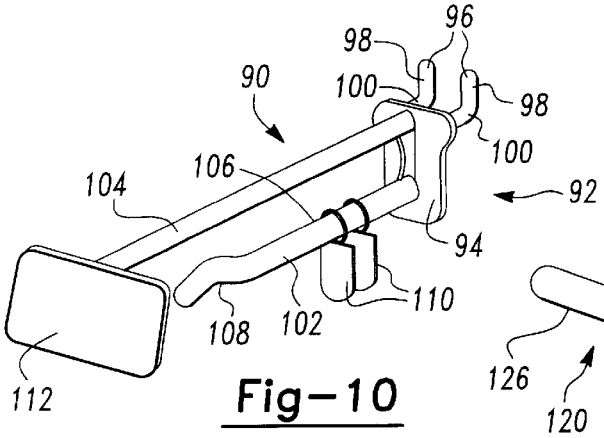
FIG. 10 is a view of a peghook assembly also illustrated in operative engagement with a selected strip display assembly in FIG. 9 according to the present invention.
Figure 11:
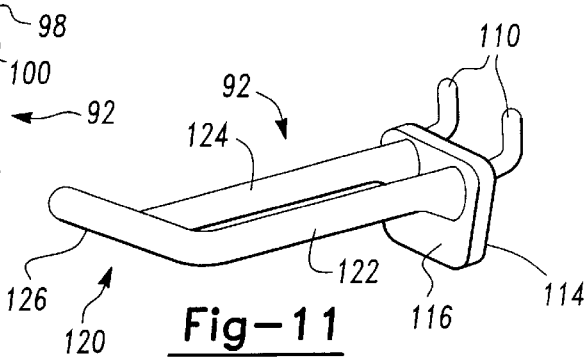
FIG. 11 is a view of a peghook assembly also illustrated in operative engagement with a selected strip display assembly in FIG. 9 according to the present invention.

While numerous variations of different types of merchandising support members are illustrated throughout the drawings, sectional views in perspective are shown in FIG. 10 for a first example 90 of a merchandising support member and at 92 in FIG. 11 for a second example of a support member which better illustrate the features of the support members. Referring to FIG. 10, the merchandising support member 90 again includes a hook engaging portion 92 which is made up of a planar shaped base portion 94 and extending rearwardly from which are first and second "L" shaped and aperture engaging tabs 96. As is again illustrated upon reference to FIG. 4, the pluralities of apertures 86 and 88 are arranged such that upwardly extending ends 98 of the engaging tabs 96 are capable of first being inserted through a pair of the apertures and the support member 90 then rotated in a downward direction until the upper ends 98 abut against a rear planar surface of the elongated strip display and additional shouldering support is provided by horizontal and rearwardly extending portions 100 of the engaging tabs 96 in combination with the rear abutting face of the planar shaped base portion 94.

An elongate merchandising support 102 extends forwardly from the planar shaped base portion 94 and includes an upper arm 104 and a lower parallel extending and spaced apart arm 106. The lower arm 106 is provided for supporting the plurality of merchandising, such as engaging the upper end of packaging within which the merchandising is carried and terminates in an angled end portion 108, the purpose of which is to prevent the merchandising illustrated at 110 from slipping off the edge of the arm 106. The upper arm 104 likewise terminates in a planar faced display area 112, the purpose for which is to provide a visible display area for advertising the merchandising product 110 or like product.

Referring to FIG. 11, the variation 92 of the merchandising support member also includes an engaging portion which includes a planar shaped base 116 and a pair of rearwardly extending tab portions 110 for engaging selected apertures. An elongated merchandise support arm 120 according to the variation 92 is provided as a first support arm 122 and a second parallel and spaced support arm 124 which extend from the planar shaped base 116 and are interconnected by a crosswise extending end portion 126. The support arm 120 is therefore constructed to carry heavier or bulkier merchandising product which would require more suspending support than would be provided by a support member such as is shown at 78, 80 or 90.

Referring back to FIG. 4, it is further evident that the ability to suspend the first and second strip displays 58 and 60 in back-to-back fashion would even further increase the rigidity of the displays and their ability to carrier more and heavier volumes of impulse merchandising without bending or buckling. As is also illustrated by the directional arrow 127 in FIG. 4, the strip displays 58 and 60 are freely suspended from the support bracket 64 so that they will freely move being contacted, such as by a shopper bumping into the display variation 56, and are therefore constructed so as to prevent injury to a user while at the same time establishing a high degree of visual awareness and utilization of otherwise unused dead space extending from the front surface of such existing shelving displays.

Figure 5:
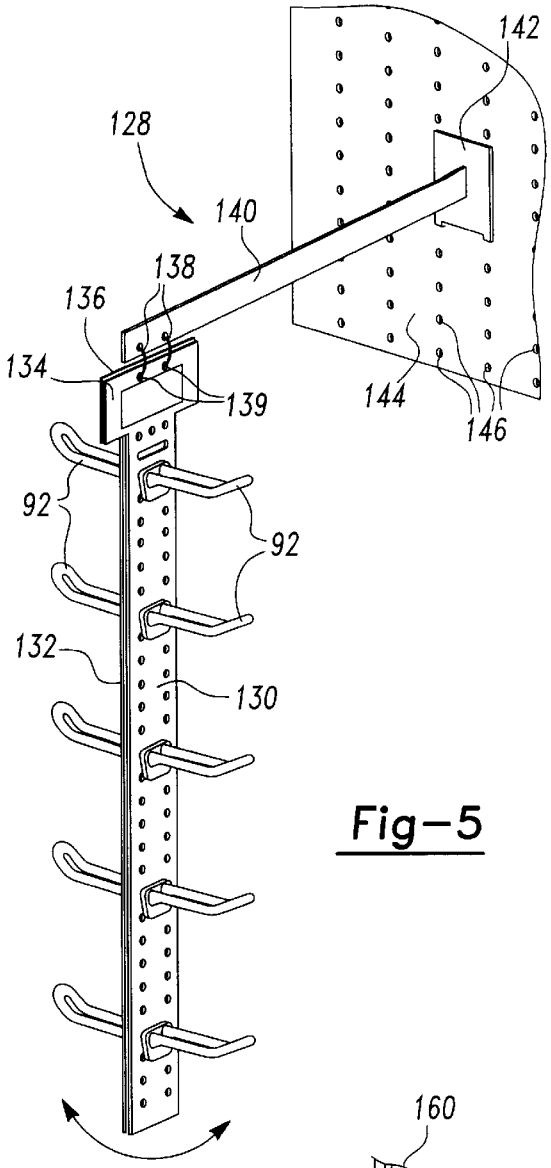
FIG. 5 is a view similar to that shown in FIG. 4 and illustrating a slightly modified variation of the strip display assembly secured to a pegboard surface according to the present invention.

Referring to FIG. 5, a yet further variation 128 is illustrated of a strip display assembly according to the present invention and, similar to the embodiment 56 shown in FIG. 4, includes a first elongate display 130 and a second elongate display 132 which are likewise secured in suspended and back-to-back fashion and further including additional pluralities of existing merchandising support members 88 such as have been previously described. As with each of the previously disclosed embodiments, the strip displays each include oppositely facing planar faces with pluralities of apertures formed therethrough at selected locations and merchandising support members, in this case the support members according to the variation 92 described in FIG. 11, are mounted to selected pairs of the apertures at selected locations along both the strip displays 130 and 132. Located at upper ends of the strip displays 130 and 132 are enlarged display head portions 134 and 136 which are capable of supporting advertising indicia relating to the merchandising to be displayed and a pair of hooks 138 are shown which engage additional apertures 139 formed in upper edges of the display head portions and which suspend the strip displays 130 and 132 from an elongate support arm 140 in a freely swinging manner. The support arm according to this embodiment is an integral one-piece bracket which at an opposite end terminates in a planar shaped base support 142. The base support 142 mounts to a conventional pegboard surface 144, and preferably to selected apertures from pluralities of apertures 146 formed in the pegboard surface 144, and additional tab engaging portions (not shown) extend from a rear surface of the base support 142 to effect mounting of the elongate support arm 140.

Figure 6:
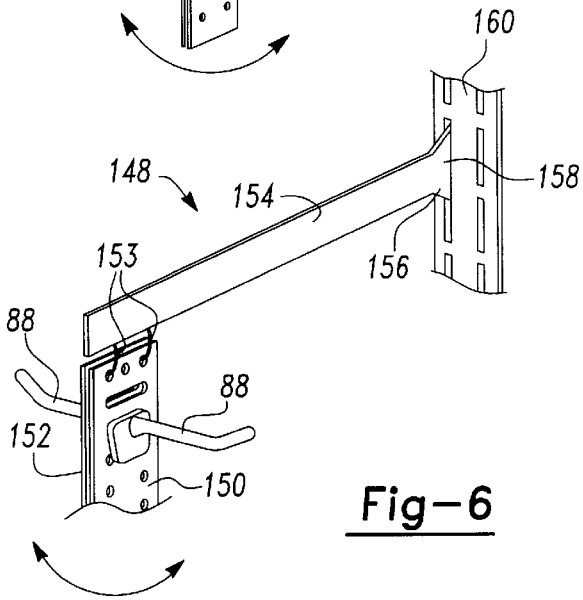
FIG. 6 is a partial view of a still yet further variation of the strip display assembly similar to that shown in FIG. 4 and further illustrating a vertically extending and double slotted surface of an existing shelving construction according to the present invention.

Referring to FIG. 6, a still further variation 148 of a strip display assembly is shown and includes a first strip display 150 and a second strip display 152 arranged in back-to-back fashion and suspended in freely swingable fashion by a pair of hooks 153 extending from a horizontally arrayed support arm 154. The support arm terminates at a remote end in a bracket engaging portion 156 which is engagably supported within any one of a plurality of slotted apertures 158 extending in vertical fashion along a double-slotted vertical support surface 160, such surface 160 comprising a portion of an existing shelving display according to the prior art.

Figure 7:
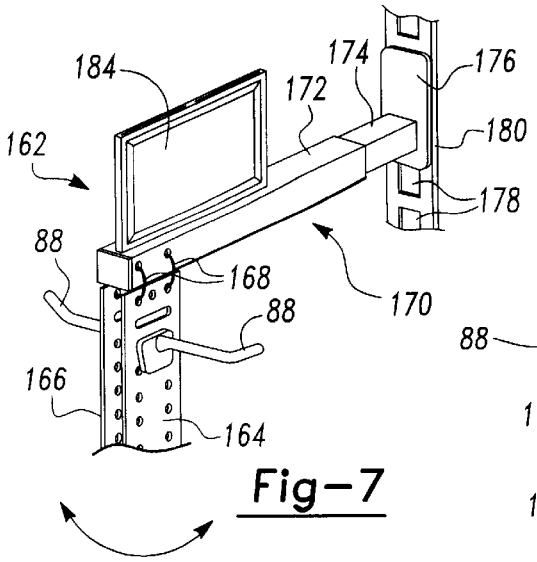
FIG. 7 is a partial view of a yet further variation of a strip display assembly suspended in spatially extended manner by a telescopingly readjustable bracket arm according to the present invention.

Referring to FIG. 7, a still further variation 162 of a strip display assembly is shown and once again includes a first strip display 164 and a second strip display 166 which are freely suspended in somewhat back-to-back but slightly more spaced apart fashion by a pair of hooks 168 extending from a horizontally extending support arm assembly 170. The support arm 170 according to the further preferred variation is telescoping merchandising display arm and includes a first elongate and polygonal shaped member 172 which is engaged in a telescoping and axially extendible/retractable manner to a second elongate and polygonal shaped member 174 . The first and second members 172 and 174 are capable of being axially repositioned to adapt to differing lengths so as to accommodate the spacing of the display assembly relative to the existing shelving display. A planar shaped base support 176 is secured to an end of the second elongate member 174 and is in turn includes tab engaging members (not shown) which effectively mount the telescoping assembly 170 to a selected aperture of a plurality of apertures 178 extending at spaced increments along a slotted vertical mounting surface 180. A display portion 184 may also be secured along an upper extending edge of the telescoping assembly 170 for displaying an advertisement of the merchandising supported upon the strip display assembly 162.

Figure 8:
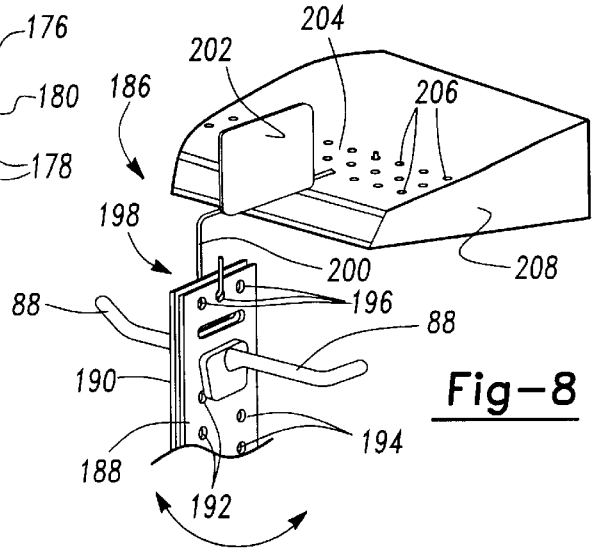
FIG. 8 is a partial view of a yet further variation of a strip display assembly suspended by a hook member according to the present invention.

Referring to FIG. 8, a yet further variation 186 of a strip display assembly is shown and includes first and second elongated display strips 188 and 190 which are again arranged in back-to-back and freely suspended fashion and which also include the merchandising support members 88 as previously disclosed. The display strips 188 and 190 include the individual pluralities of apertures as previously disclosed, such as at 192 and 194 and along the top edge at 196 and a hanger assembly 198 includes a lower hook portion 200 which engages selected apertures 196 of the strips 188 and 190 to freely suspend the display assembly. The hanger assembly 198 further includes a planar display area 202 for providing advertising of the merchandising to be placed upon the display assembly. A shelving engaging portion is provided by an upper substantially "U" shaped and engaging portion 204 which is illustrated partially in phantom and by which the hanger assembly 198 can be secured to selected apertures of a plurality of apertures 206 formed along a horizontal surface of an extending shelving construction 208 and can in turn support the display assembly 186 in a horizontally spaced and freely swingable fashion.

Figure 9:
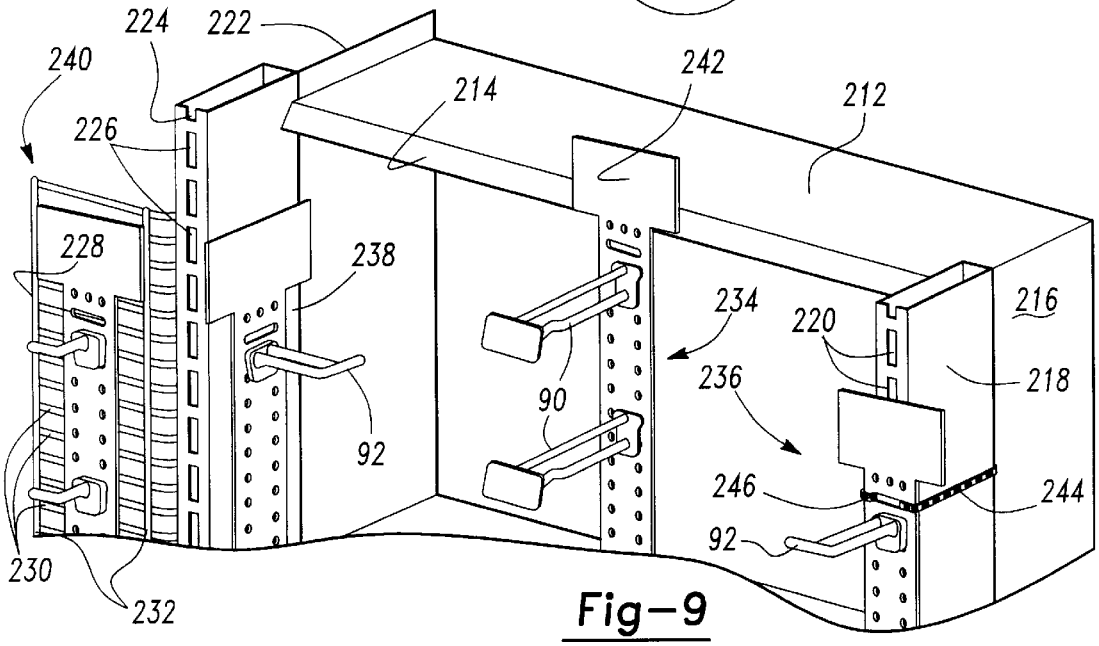
FIG. 9 is an environmental view, partially in section, and illustrating a variety of strip display assemblies secured at varied locations along a conventional shelving construction.

Referring finally to FIG. 9, an environmental view 210 is illustrated of a plurality of individual strip display assemblies which are installed at various locations along a conventional shelving display and which illustrates the multitude of impulse merchandising applications that the present invention is capable of performing. The shelving display is illustrated at 212 and includes a body with an upper frontal extending edge 214, a first side 216 having secured at a forward end thereto a first vertically extending wing rack 218 with vertically slotted apertures 220, a second side 222 having also secured thereto at a forward end second vertically extending wing rack 224 with vertically slotted apertures 226. An additional wire rack 228 is secured in angular fashion to the second wing rack 224 and is constructed in a lattice-type configuration with spaced apart horizontally extending members 230 and vertically extending members 232.

For use with the shelving display of FIG. 9, a plurality of individual strip display assemblies are provided and include a first strip display 234, a second strip display 236, a third strip display 238 and a fourth strip display 240. The first strip display 234 includes an elongated body of standard variation identical to the embodiment described in FIG. 2 and merchandise support members 90 such as described in FIG. 10 may be releasably secured to selected apertures form along the axial length of the body. An enlarged display head 242 at the upper end of the elongated body may include an adhesive applied to a rear face thereof (not shown) for attaching the strip display 234 to the frontal extending edge 214 of the shelving construction.

The second strip display 236 is of substantially identical construction as the first strip display 234 with the exception that it makes use of the merchandising support members (or peg hooks) 92 as illustrated in FIG. 5. A strap 244 is provided and may engage the second strip display 236 through its elongated channel 246 and encircles the circumference of the first wing rack 218 to support the second strip display 236 in abutting fashion against the forward surface of the wing rack through which the apertures 220 are formed.

The third strip display 238 is likewise constructed in identical fashion to the second display 236 and is adhesively secured along its rear planar face to an inwardly facing side surface of the second wing rack 224. Finally, the fourth strip display 240 is securable to the wire rack 228 with the lattice-type configuration and this may be accomplished by the use of straps or hooks (not shown). The objective of the elongated strip displays 234, 236, 238 and 240 is to augment the available display area of the conventional shelving construction 212 by making use of the otherwise unusable space directly in front of the shelving construction 212 and by successfully displaying in prominent fashion high-volumes of impulse merchandising. The strip display assemblies further function to effectively display the impulse merchandising without obscuring the other merchandise supported upon the conventional shelving.

The present invention therefore discloses a strip display assembly which is an improvement over prior art "clip-strips" in that it makes possible the effective display of larger volumes of impulse merchandising in either fixed or freely suspended fashion relative to an existing shelving display surface by the use of a wide variety of fixed and telescopable mounting support brackets. The built-in rigidity of the elongated strips provided by the internal corrugations combined with the releasably securable peg hooks merchandise support members makes possible the ability to load large quantities of merchandising on a given strip display without the concern of overloading the display or of having the display bend or buckle.

It is further envisioned that the display strips of the present invention may be ordered pre-packed with the specified impulse merchandising from the manufacturer and, along with the variety of mounting bracketry provided, would facilitate quicker installation at the commercial establishment, thus reducing time and effort while increasing profits. The strip display assembly of the present invention further provides for easier refilling and disposal and is more easily secured to existing shelving constructions than the prior art clip-strip devices.

Having described my invention, additional numerous embodiments will become apparent to those skilled in the art to which it pertains without deviating from the scope of the appended claims.

I claim:

1. A strip display assembly for supporting high volume merchandising items, said strip display assembly capable of being secured to an existing shelving construction and comprising:

an elongated body having an upper end, a lower end, a front planar face and a rear planar face spaced from said front planar face and extending between said upper and said lower end;

reinforcing means separating and spacing said front planar face from said rear planar face according to a selected thickness, said reinforcing means providing rigidity along an axial direction of said strip assembly;

said reinforcing means further including a plurality of spaced parallel corrugations extending at an angle to said front planar member and said rear planar member, said corrugations being spaced transversely of said elongated body to form enclosed spaces along the axial length of said elongated body between said front planar face and said rear planar face from said upper end to said lower end of said elongated body;

suspending means for securing said upper end of said elongated body to the shelving construction to support said elongated body in a freely swinging and in a vertical fashion from the shelving construction, said suspending means further including a horizontally extending bracket having a first end and a second end, said bracket being capable of being secured at said first end to a surface of the shelving construction, said second end of said bracket including hook portions for engaging said upper end of said elongated body to dispose said elongated body in a freely suspended manner and at a spaced apart distance from the shelving construction;

a plurality of apertures formed in said front and rear planar faces of said body at spaced apart intervals along an axial length of said elongated body and opening into said enclosed spaces;

a plurality of individual merchandise support members, each of said support members including at least one hook portion for extending into at least one selected aperture of said plurality of apertures and into one of said enclosed spaces; and each of said merchandise support members further including an elongated merchandise support arm extending outwardly from one of said planar faces when said hook portion is inserted into one of said apertures, said support arm being capable of supporting a plurality of merchandising items.

2. The strip display assembly according to claim 1, said merchandising support members further comprising peg-hook members, said hook engaging portions each further including a planar shaped base with inwardly facing and "L" shaped engaging tabs for engaging selected apertures along said elongated body.

3. The strip display assembly according to claim 1, said extending bracket further comprising a first telescoping portion and a second telescoping portion capable of readjusting a spatial distance between said freely suspended elongated body and the shelving construction.

4. The strip display assembly according to claim 1, said plurality of parallel extending corrugations being established at an angle relative to a perpendicular of said front and rear planar faces.

* * * * *